US011454052B2

(12) United States Patent
Guerin et al.

(10) Patent No.: US 11,454,052 B2
(45) Date of Patent: Sep. 27, 2022

(54) HANDLE FOR A VEHICLE DOOR

(71) Applicant: U-Shin Italia S.p.A., Pianezza (IT)

(72) Inventors: Anthony Guerin, Pianezza (IT); Antonio Rocci, Pianezza (IT); Siavash Ostovari-Far, Pianezza (IT)

(73) Assignee: U-Shin Italia S.p.A., Pianezza (IT)

( * ) Notice: Subject to any disclaimer, the term of this patent is extended or adjusted under 35 U.S.C. 154(b) by 1186 days.

(21) Appl. No.: 15/966,938

(22) Filed: Apr. 30, 2018

(65) Prior Publication Data

US 2018/0245380 A1 Aug. 30, 2018

Related U.S. Application Data

(63) Continuation of application No. PCT/EP2016/076737, filed on Nov. 4, 2016.

(30) Foreign Application Priority Data

Nov. 6, 2015 (EP) ..... 15193475

(51) Int. Cl.
*E05B 79/20* (2014.01)
*E05B 85/16* (2014.01)
(Continued)

(52) U.S. Cl.
CPC ..... *E05B 79/20* (2013.01); *E05B 81/76* (2013.01); *E05B 85/103* (2013.01);
(Continued)

(58) Field of Classification Search
CPC ..... E05B 79/20; E05B 81/76; E05B 81/04; E05B 85/107; E05B 85/103; E05B 81/16;
(Continued)

(56) References Cited

U.S. PATENT DOCUMENTS 3,993,338 A * 11/1976 Cherbourg ..... B60J 5/06 292/336.3
4,641,747 A * 2/1987 Mestdagh ..... G11B 33/0444 206/308.1
(Continued)

FOREIGN PATENT DOCUMENTS

DE 102018121432 A1 * 3/2020 ..... E05B 77/04
DE 102019114452 A1 * 12/2020 ..... E05B 85/107
(Continued)

OTHER PUBLICATIONS

International Search Report for International Application PCT/EP2016/076737, dated Dec. 16, 2016.

*Primary Examiner* — Christine M Mills
*Assistant Examiner* — Faria F Ahmad
(74) *Attorney, Agent, or Firm* — Burris Law, PLLC

(57) ABSTRACT

A handle for a vehicle door is provided that includes an activation member configured to activate a latch of a vehicle door and a grip member that cooperates with the activation member to unlatch the door. The grip member is movable between a flush position where a gripping part extends flush to an external panel of the door, an active position where the gripping part is graspable by projecting from the panel and the grip member cooperates with the activation member, and an opening position where the grip member drives the activation member to activate the latch and unlatch the door. In one form, a driving mechanism and actuator lever drives the grip member between the flush and active position. When the grip member is pulled in an opening direction, the grip member drives the activation member which in turn activates the latch to unlatch the door.

20 Claims, 6 Drawing Sheets

(51) Int. Cl.

| | |
|---|---|
| ***E05B 85/10*** | (2014.01) |
| ***E05B 81/76*** | (2014.01) |
| ***E05B 81/06*** | (2014.01) |
| ***E05B 81/16*** | (2014.01) |
| ***E05B 81/64*** | (2014.01) |
| ***E05B 81/84*** | (2014.01) |

(52) U.S. Cl.
CPC ..... *E05B 85/107* (2013.01); *E05B 85/16* (2013.01); *E05B 81/06* (2013.01); *E05B 81/16* (2013.01); *E05B 81/64* (2013.01); *E05B 81/84* (2013.01); *Y10S 292/04* (2013.01); *Y10S 292/31* (2013.01); *Y10T 292/1082* (2015.04); *Y10T 292/57* (2015.04)

(58) Field of Classification Search
CPC ..... E05B 81/64; E05B 81/84; E05B 85/16; E05B 81/106; E05B 51/005; E05B 65/104; Y10T 292/57; Y10T 292/1082; Y10S 292/04; Y10S 292/31
See application file for complete search history.

(56) References Cited

U.S. PATENT DOCUMENTS

| | | | | | |
|---|---|---|---|---|---|
| 5,123,687 | A * | 6/1992 | Pfeiffer | E05B 1/0092 | 292/336.3 |
| 5,632,516 | A * | 5/1997 | Schwab | E05B 85/18 | 292/336.3 |
| 5,743,575 | A * | 4/1998 | McFarland | E05B 77/42 | 16/82 |
| 6,318,771 | B1 * | 11/2001 | Holloway | B60K 15/05 | 292/201 |
| 6,367,124 | B1 * | 4/2002 | Bella | E05B 17/0041 | 16/438 |
| 6,536,080 | B2 * | 3/2003 | Bella | E05B 17/0041 | 16/412 |
| 6,698,262 | B2 * | 3/2004 | Wittwer | E05B 85/107 | 70/208 |
| 9,062,478 | B2 * | 6/2015 | Bingle | E05B 81/28 | |
| 9,249,608 | B2 * | 2/2016 | Lang | E05B 85/107 | |
| 9,322,191 | B2 * | 4/2016 | Muller | E05B 85/107 | |
| 10,280,658 | B2 * | 5/2019 | Halliwell | E05B 85/107 | |
| 10,435,926 | B2 * | 10/2019 | Brown | E05B 85/16 | |
| 10,550,611 | B2 * | 2/2020 | Och | E05B 85/107 | |
| 10,760,307 | B2 * | 9/2020 | Rocci | E05B 85/16 | |
| 10,794,096 | B2 * | 10/2020 | Hamacher | E05B 5/006 | |
| 10,920,462 | B2 * | 2/2021 | Guerin | E05B 85/16 | |
| 2002/0121786 | A1 * | 9/2002 | Meinke | E05B 85/107 | 292/347 |
| 2005/0280266 | A1 * | 12/2005 | Mueller | E05B 77/42 | 292/336.3 |
| 2013/0121008 | A1 * | 5/2013 | Muller | E05B 5/003 | 362/501 |
| 2013/0170241 | A1 * | 7/2013 | Lesueur | E05B 83/36 | 362/501 |
| 2014/0000167 | A1 * | 1/2014 | Patel | E05B 85/103 | 49/32 |
| 2014/0132012 | A1 * | 5/2014 | Yoshino | E05B 85/103 | 292/336.3 |
| 2014/0300115 | A1 * | 10/2014 | Vasi | E05B 85/103 | 292/336.3 |
| 2014/0312633 | A1 * | 10/2014 | Ilardo | E05B 85/16 | 292/336.3 |
| 2015/0191942 | A1 * | 7/2015 | Ilardo | E05B 77/42 | 292/336.3 |
| 2016/0290018 | A1 * | 10/2016 | Hamacher | E05B 85/103 | |
| 2016/0298366 | A1 * | 10/2016 | Och | E05B 85/103 | |
| 2018/0148957 | A1 * | 5/2018 | Och | E05B 85/107 | |
| 2018/0274271 | A1 * | 9/2018 | Och | E05B 85/103 | |
| 2019/0383066 | A1 * | 12/2019 | Han | E05B 85/103 | |

FOREIGN PATENT DOCUMENTS

| | | | | |
|---|---|---|---|---|
| EP | 2730730 | | 5/2014 | |
| GB | 2506350 | | 4/2014 | |
| WO | WO-2012175599 | A1 * | 12/2012 | E05B 85/16 |
| WO | 2015/073119 | | 5/2015 | |
| WO | WO-2019172057 | A1 * | 9/2019 | E05B 81/06 |

* cited by examiner

HANDLE FOR A VEHICLE DOOR

CROSS-REFERENCE TO RELATED APPLICATIONS

This application is a continuation of International Application No. PCT/EP2016/076737, filed on Nov. 4, 2016, which claims priority to and the benefit of EP 15193475.9 filed on Nov. 6, 2015. The disclosures of the above applications are incorporated herein by reference.

FIELD

The present disclosure relates to handles for a vehicle door, and more particularly to handles referred to as "flush handles."

BACKGROUND

The statements in this section merely provide background information related to the present disclosure and may not constitute prior art.

Handles for vehicle doors are components having a significant influence on the style of vehicles. In this respect, vehicle manufacturers often seek to arrange the handle in the plane of the door so that it occupies a flush position also called a flush arrangement. A flush handle generally renders the handle as invisible as possible. Such flush door handles also have the advantage of reducing the aerodynamic noise caused by the rush of air as the vehicle is being driven along.

A flush handle has been proposed with a grip member and a moveable flap configured to be moved by a user to grab the grip member and pull the grip member to open the vehicle door.

Such a handle requires an arrangement with additional pieces including means for maintaining the flap so as to avoid movements of the flap when the car is moving.

Moreover, such a handle turns out inconvenient in use as the user needs to make preliminary movements to have access to the grip member.

SUMMARY

The present disclosure provides a flush handle where a flap is not needed, and wherein the preliminary movements of the user are reduced.

To this end the present disclosure relates to a handle for a vehicle door, comprising:

an activation member configured to activate a latch of a vehicle door so as to unlatch the door, and a grip member configured to cooperate with the activation member so as to unlatch the door, wherein the grip member comprises a gripping part, the grip member being movable between:

a flush position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door, and a driving mechanism and an actuator lever cooperating with the grip member such that the grip member may be driven between the flush position and the active position, wherein the handle being configured such that when the grip member is pulled according to an opening direction, the grip member drives the activation member which in turn activates the latch to unlatch the door.

Advantageously, the flush handle of the present disclosure has a simple arrangement in which a flap is not needed, thereby making the handle more convenient to use.

According to further forms which can be considered alone or in combination:

the handle further comprises a grip return configured to drive the grip member towards the flush position, the actuator lever is moveable between:

an activating position in which the actuator lever drives the gripping member towards the active position; and a rest position in which the actuator lever releases the grip member, and the handle further comprises:

an actuator return configured to drive the actuator lever towards the activating position, and a retaining device for retaining the actuator lever in the rest position; and/or the handle further comprises a grip return configured to drive the grip member towards the active position, the actuator lever is moveable between:

a locking position in which the actuator lever blocks the grip member in the flush position, and an unlocking position in which the actuator lever enables the grip member to move towards the active position, and the handle further comprises:

an actuator return configured to drive the actuator lever towards the locking position, and a retaining device for retaining the actuator lever in the unlocking position; and/or the retaining device comprises a pressure sensitive bistable spring mechanism connected to the actuator lever and to a bracket, the bistable spring mechanism being movable between a retaining state in which the actuator lever is retained in the rest position or in the unlocking position, and a releasing state in which the actuator lever is released from said position; and/or the retaining device comprises a clicking device configured to produce a clicking sound when the actuator lever is released from the rest position or from the unlocking position; and/or the actuator lever is driven by a motor; and/or the driving mechanism comprises a motor configured to drive the actuator lever which in turn drives the grip member between the flush position and the opening position; and/or the handle further comprises at least one first switch and a first circuit, closed by a contact between the activation member and the grip member; and/or the handle further comprises at least one second switch on the motor or on the actuator lever and at least one second circuit, the at least one second switch and the second circuit being configured to inform a user on the state of the actuator lever; and/or the grip member comprises a driven structure and the actuator lever comprises a driving structure cooperating with the driven structure, and when the actuator lever is moved from the rest position to the activating position, the driving structure drives the driven structure such that the gripping part is moved from the flush position to the active position; and/or the grip member comprises a first locking structure and the actuator lever comprises a second locking structure cooperating with the first locking structure, and when the grip member is moved from the active position to the opening position, the first locking structure drives the second locking structure so as to drive the actuator lever towards the rest position such that the actuator lever presses and is retained by the retaining device; and/or the grip member comprises a first locking structure defining a first trajectory when the grip member is moved from the flush position to the active position, and the actuator lever comprises a second locking structure, in the locking position, the second locking structure blocks the first locking structure so as to block the grip member in the flush position, and in the unlocking position, the second locking structure is moved out of the first trajectory of the first locking structure; and/or the grip member comprises a driving structure and the actuator lever comprises a driven structure cooperating with the driving structure such that when the grip member is in the flush position and the gripping part is pressed from outside the door, the driving structure drives the driven structure such that the actuator lever presses the retaining device which in turn releases the actuator lever from the unlocking position; and/or when the gripping part moves from the active position to the opening position, the first locking structure cooperates with the second locking structure so as to drive the actuator lever along a second trajectory such that the actuator lever presses the retaining device which in turn releases the actuator lever from the unlocking position; and/or the grip member is rotatably mounted about a grip axis and the actuator lever is rotatably mounted about an actuator axis and the grip axis and the actuator axis are substantially parallel to each other; and/or the grip member comprises a column projecting towards the external panel and the column comprises a first opening protuberance cooperating with a second opening protuberance on the activation member to unlatch the vehicle door, the driving structure being on the column; and/or the actuator lever has two opposite ends, and the second locking structure is placed at one end and the driven structure is placed at the opposite end.

According to a second aspect, the handle of the present disclosure comprises:

an activation member configured to activate a latch of a vehicle door so as to unlatch the door;

a grip member configured to cooperate with the activation member so as to unlatch the door, wherein the grip member comprises a gripping part, the grip member being movable between:

a flush position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door, and a grip return configured to drive the grip member towards the flush position, and an actuator lever cooperating with the grip member, wherein the actuator lever is moveable between:

an activating position in which the actuator lever drives the gripping member towards the active position, and a rest position in which the actuator lever releases the grip member;

an actuator return configured to drive the actuator lever towards the activating position; and a retaining device for retaining the actuator lever in the rest position, wherein the handle being configured such that when the grip member is pulled according to an opening direction, the grip member drives the activation member which in turn activates the latch to unlatch the door.

According to another aspect, the handle of the present disclosure comprises:

an activation member configured to activate a latch of a vehicle door so as to unlatch the door;

a grip member configured to cooperate with the activation member so as to unlatch the door, wherein the grip member comprises a gripping part, the grip member being movable between:

a flush position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door;

a grip return configured to drive the grip member towards the active position;

an actuator lever cooperating with the grip member, wherein the actuator lever is moveable between:

a locking position in which the actuator lever blocks the grip member in the flush position, and an unlocking position in which the actuator lever enables the grip member to move towards the active position;

an actuator return configured to drive the actuator lever towards the locking position; and a retaining device for retaining the actuator lever in the unlocking position.

According to another aspect, the handle of the present disclosure comprises:

an activation member configured to activate a latch of a vehicle door so as to unlatch the door;

a grip member configured to cooperate with the activation member so as to unlatch the door, wherein the grip member comprises a gripping part, the grip member being movable between:

a flush position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door; and a driving mechanism and an actuator lever cooperating with the grip member, wherein the driving mechanism comprises a motor configured to drive the actuator lever which in turn drives the grip member between the flush position and the opening position, wherein the handle is configured such that when the grip member is pulled according to an opening direction, the grip member drives the activation member which in turn activates the latch to unlatch the door.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
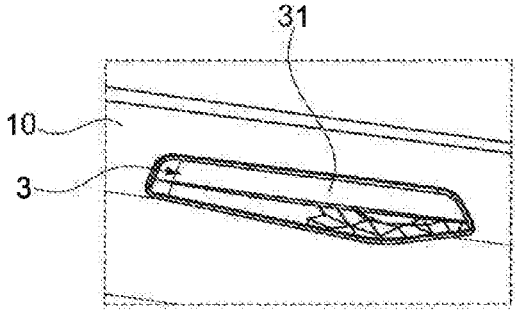
FIG. 1 is a perspective view of a handle with a motorized actuation lever in a flush position according to a first form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1 to 8, a handle according to a first form of the present disclosure comprises a grip member 3 and an activation member 2. The handle enables a user to open a vehicle door comprising an external panel 10.

Figure 2:
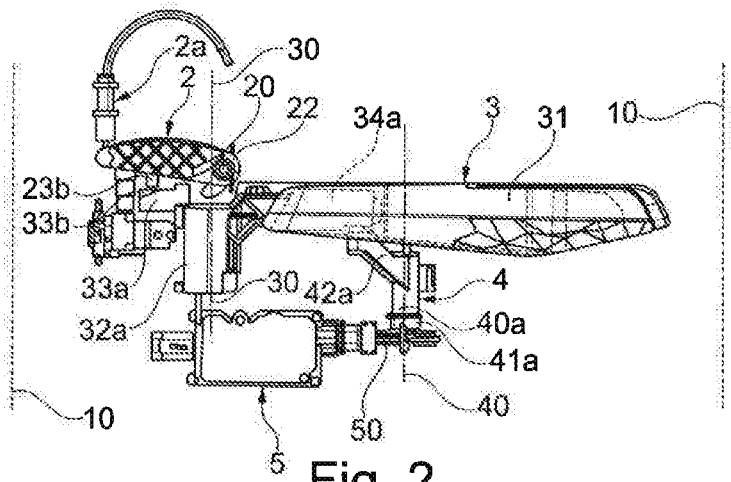
FIG. 2 is a side view of the handle of FIG. 1.

The activation member 2 is configured to activate a latch 2*a*. The latch 2*a* comprises a Bowden cable as shown in FIG. 2. In particular, the activation member 2 pulls the Bowden cable such that the door is unlatched and may be opened.

The activation member 2 is a longitudinal lever. The activation member 2 is rotationally mounted about an activation axis 20 shown in FIGS. 2 and 5.

The grip member 3 comprises a gripping part 31 and a grip lever 32*a*. The gripping part 31 is configured to be grasped by a user trying to open the door. The gripping part 31 is connected to the grip lever 32*a*.

The grip lever 32*a* has a first arm 34*a* connected to the gripping part 31 and a second arm 33*a* configured to cooperate with the activation member 2. The grip lever 32*a* is rotationally mounted about a grip axis 30.

The grip lever 32*a* is configured to cooperate with the activation member 2 to activate the latch 2*a*. In particular, the grip lever 32*a* comprises a cam surface 33*b* on which a protuberance 23*b* of the activation member slides such that the activation member 2 is rotated about the rotation axis 20 and activates the latch 2*a*.

The gripping part 31 comprises a recess configured to receive at least one or more fingers so as to be grasped. The handle is configured such that when the gripping part 31 is pulled downwardly according to reference 3*b* in FIG. 6, the grip lever 32*a* is rotated about the grip axis 30 in an opening direction, which is here a clockwise direction, in reference to FIGS. 3 and 6. As the grip lever 32*a* is rotated, the protuberance 23*b* of the activation member 2 slides on the cam surface 33*b* such that the activation member 2 activates the latch 2*a*.

The grip member 3 is movable between a flush position, an active position and an opening position.

Figure 3:
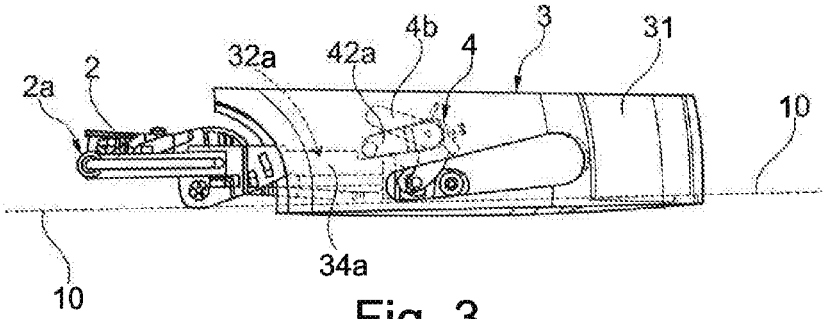
FIG. 3 is a top view of the handle of FIG. 1.

The flush position is shown in FIGS. 1 to 3. In this position the gripping part 31 extends flush to an external panel 10 of the door. To this end, the gripping part 31 comprises an external surface substantially aligned with the external panel 10 as shown in FIGS. 1 and 3. In FIGS. 1 and 2, the external panel 10 extends along the plane of the drawing sheet.

Figure 4:
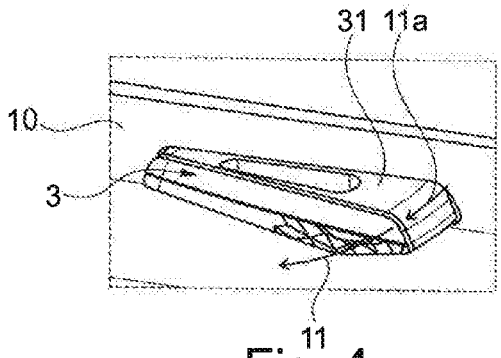
FIG. 4 is a perspective view of a handle with a motorized actuation lever in an active position according to a first form of the present disclosure.
Figure 5:
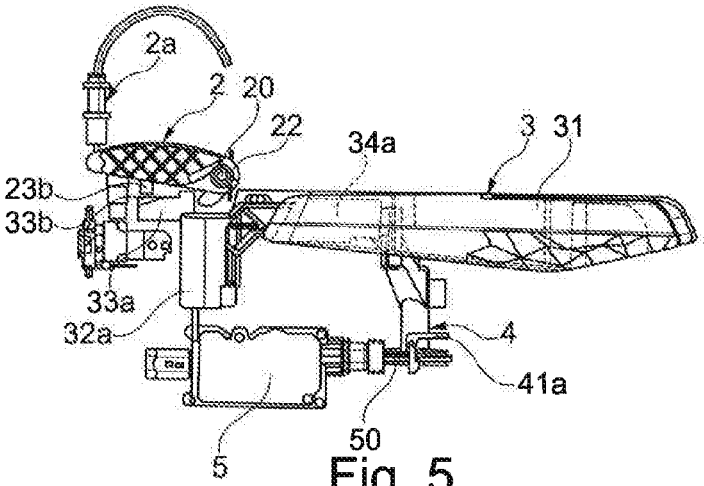
FIG. 5 is a side view of the handle of FIG. 4.
Figure 6:
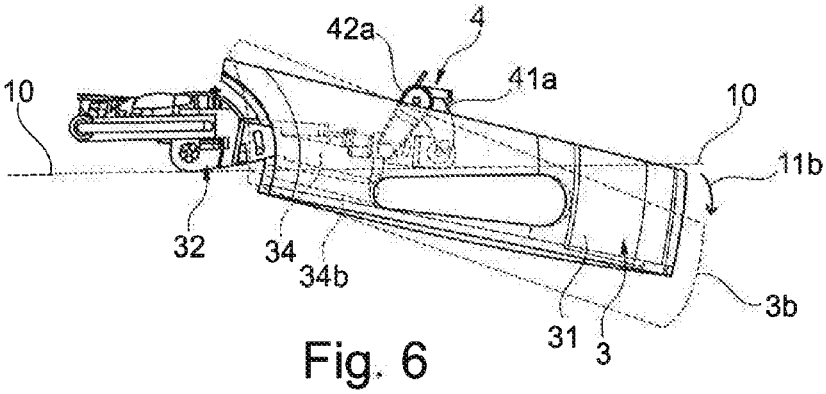
FIG. 6 is a top view of the handle of FIG. 4.

The active position is shown in FIGS. 4 to 6. In this position the gripping part 31 projects outwardly with respect to the external panel 10 such that the grip recess is accessible by a user. This movement is shown by arrow 11*a*.

In addition, the grip member is configured to cooperate with the activation member 2 when put in the active position. In particular, the grip lever 32*a* is brought closer the activation member such that the protuberance 23*b* of the activation member 2 contacts the cam surface 33*b*, and may slide if the gripping part is actuated. To this end, as shown in FIGS. 2 and 4, the arm 33*a* and the cam surface 33*b* are shifted to the right of the figures and the cam surface 33*b* is placed in front of the protuberance 23*b*.

Figure 7:
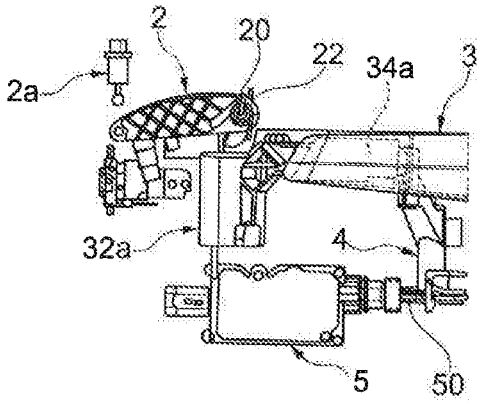
FIG. 7 is a side view of a handle in an opening position according to a first form of the present disclosure.

The opening position is shown by reference 3*b* in FIG. 6 and FIG. 7. The grip member 3 is configured to reach the opening position after being in the active position. In the opening position, the gripping part 31 is pulled outwardly according to the arrow 11 such that the grip lever 32*a* cooperates with the activation member 2 to unlatch the door.

When the gripping part 31 is moved according to an outward direction, as shown by arrow 11 in FIG. 6, so as to reach the open position shown by reference 3*b*, the grip lever 32*a* is also rotated about the grip axis 30 and the second arm 34*a* reaches the opening position 34*b*. In addition, the activation lever 2 rotates about the activation axis 20 to unlatch the vehicle door.

The handle of the present disclosure further comprises an actuator lever 4, also called "command lever" and configured to cooperate with the grip member 3 so as to drive the grip member 3 between the flush position and the active position.

In the first form, the actuator lever 4 cooperates with the grip lever 32*a* to drive the grip member 3 from the flush position to the active position as shown in FIGS. 1 to 6. More particularly, the actuator lever 4 is configured to push the grip lever 32*a* and thereby cause the gripping part 31 to project outwardly with respect to the external panel 10 of the vehicle door.

The actuator lever 4 has a central shaft 40*a* having two extremities, in particular an upper end and a lower end. The actuator lever 4 further comprises a driving shaft 41*a* and a driven shaft 42*a*. The driven shaft 42*a* is connected to the upper end of the central shaft 40*a*. The driving shaft 41*a* is connected to the lower end of the central shaft 40*a*.

The driven shaft 42*a* is configured to cooperate with the second arm 34*a* of the grip lever 32*a* to move the grip member 3 from the flush position to the active position. To this end, the actuator lever 4 is rotationally mounted about an actuator axis 40 passing through the central shaft 40*a*.

In one variation, the actuation lever has an inactive position 4*b* in which the driven shaft 42*a* is away from the arm 34*a* of the grip lever 32*a*.

In another variation, the grip member 3 is spring biased to move from the opening position to the active position.

In the first form, the actuator lever 4 is actuated by a motor 5 comprising a motor shaft 50 connected to the driving shaft 41.

In operation, when the grip member 3 is in the flush position, the user wanting to open the corresponding vehicle door gives information to the driving system for example by a wireless transmission through the vehicle key or the like. The motor 5 receives the information and drives the actuation lever 4 which in turn drives the grip member 3, in particular the grip lever 32*a*, such that the grip member 3 is moved from the flush position to the active position.

When the grip member 3 is in the active position, the user may pull the gripping part 31 according to an opening direction 11 toward the open position such that the grip member drives the activation member 2 to open the door. In this movement, the grip member is disengaged from actuator lever 4 as shown in FIG. 6, reference 3*b* disengaged from arm 42*a* of the actuator lever 4.

In one variation, the grip member 3 comprises a grip return configured to make the grip member 3 return from the opening position to the active position, and in one form, the grip return returns the grip member 3 from the opening position to the flush position.

In particular, the actuation lever 4 is configured to enable the grip member 3 to return to the flush position.

In an alternative form, the motor 5 through the actuator lever 4 could also drive the grip member 3 from the active position to the flush position 5.

According to an alternative form, the actuator lever 4 may be configured to make a clicking sound when the signal from the key or the like is received, and then the driving mechanism starts to drive the grip member from the flush position to the active position.

The clicking sound informs the user that the signal is received and that the driving mechanism is in course of making the grip member come from the flush position to the active position.

Figure 8:
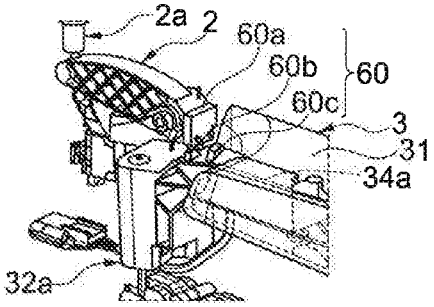
FIG. 8 is a perspective view of a handle of a first form showing switches according to the present disclosure.

According to another alternative form shown in FIG. 8, the handle may comprise at least one activation switch 60 configured to indicate that the activation member 2 is contacting the grip member 3, in particular the arm 34*a* of grip lever 32*a*.

The activation switch 60 comprises one part 60*a* on the activation element 2 and at least one part 60*b* and 60*c* on the arm 34*a* of the grip lever 32*a*. The activation switch 60 is part of an activation circuit (not represented) which indicates the contact between the activation member 2 and the arm 34*a*.

The handle may further comprise one or more motor switches configured to indicate the rotational state of the activation member 2. To this end, the motor switches are part of a motor circuit (not represented).

The switches may also inform the driving mechanism that opening is exerted and trigger an operation of the motor in the opposite sense such that the grip member 3 may return to the flush position.

Referring to FIGS. 9 to 12, the handle according to a second form of the present disclosure is similar to the one of the first form, except the actuator lever 4 is not driven by a motor. The activation member 2 and the latch 2*a* of this form are not shown in detail in the figures.

The grip lever 32*a* has a single arm 33*a* connected to the gripping part 31.

Figure 9:
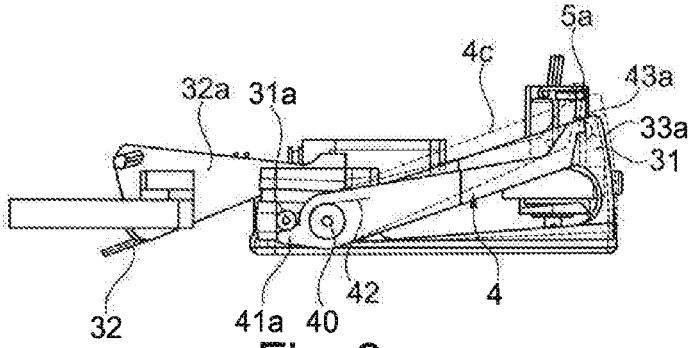
FIG. 9 is a top view of a handle with a non-motorized actuation lever in a flush position according to a second form of the present disclosure.
Figure 10:
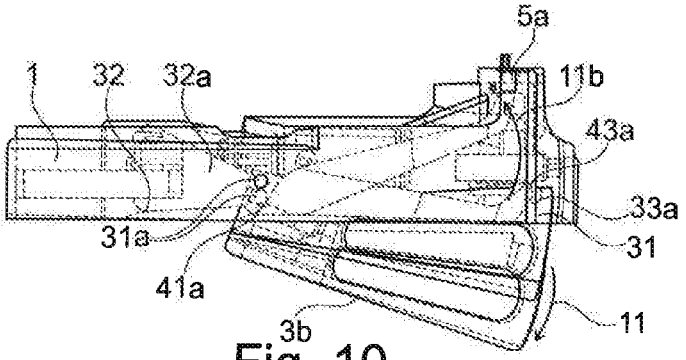
FIG. 10 is a top view of a handle with a non-motorized actuation lever in an active position according to a second form of the present disclosure.
Figure 12:
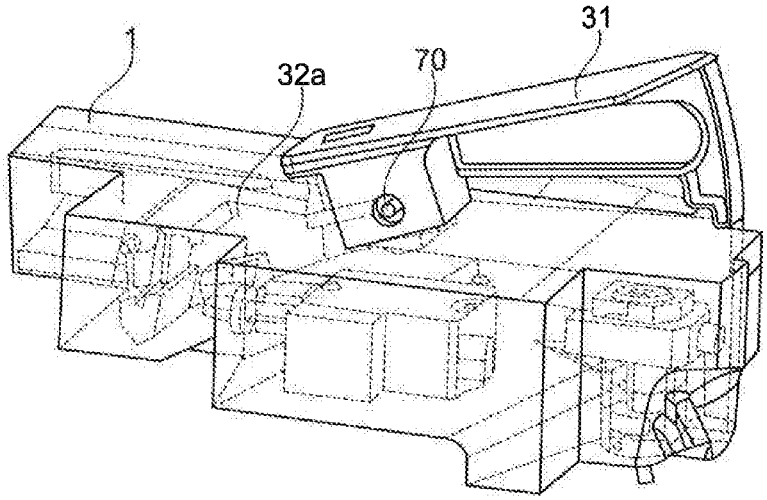
FIG. 12 is a perspective view of a handle being assembled according to a second form of the present disclosure.
Figure 13:
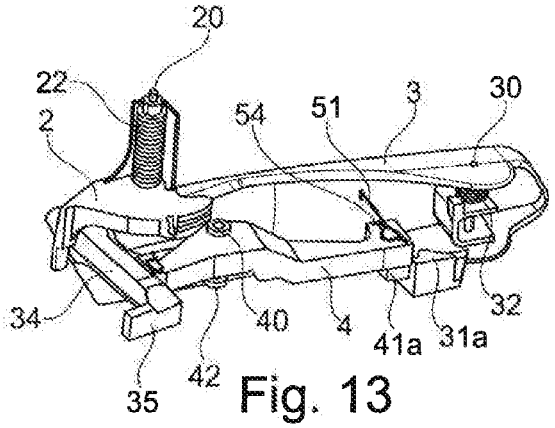
FIG. 13 is a perspective view of a handle according to a third form of the present disclosure.

In the second form, the flush position is shown in FIG. 9, the active position is shown in FIGS. 10 and 12, and the opening position is shown by reference 3*b* in FIG. 10. Space views of the flush and active positions are similar to FIGS. 1 and 4.

In the second form, the actuator lever 4 cooperates with the gripping part 31 to drive the grip member 3 from the flush position to the active position. More particularly, the actuator lever 4 comprises an actuator return 42 which is a spring 42, configured to drive the actuator lever 4 which in turn drives the grip member 2, in particular the gripping part 31 such that the grip member 3 from the flush position to the active position.

In this regard the actuator lever 4 comprises a driving structure 43*a*, which is a protuberance, and the gripping part 31 comprises a driven structure 33*c* which is a recess in which the driving structure 43*a* is engaged.

The actuator lever 4 comprises a shaft extending along and between two shafts forming a frame of the gripping part 31.

The actuator shaft is rotationally mounted about an actuator axis 40, and the grip member is rotationally mounted about a grip axis 30 substantially parallel to the actuator axis 40.

The grip member 3 is spring biased towards the flush position. A grip spring 32 is provided to this end.

In the second form, the grip member 3 is urged towards the active position by the actuator spring 42 through the actuator lever 4 and the driving and driven structures 43*a* and 33*a*. The actuator spring 42 has a force overcoming the grip spring when the actuator is driving the grip member 3.

The arrangement of the actuator lever 4 of the second form may comprised a retaining device 5*a* which is a bistable spring mechanism connected to the actuator lever 4 and to a bracket. The bistable spring mechanism being movable between a retaining state in which the actuator lever 4 is retained in a first position, and a releasing state in which the actuator lever 4 is released from to move to a second position.

A spring based actuator lever 4 and retaining device 5*a* is a mechanical arrangement of the actuator lever. Advantageously, a mechanical arrangement is usable when there is no battery in the vehicle, and a user may access the vehicle.

The actuator lever 4 is moveable between a rest position and an activating position.

The rest position is shown in FIG. 9 and in dashed lines in FIG. 10. The activating position is shown in plane lines in FIG. 10. When the actuator lever 4 moves from the rest position to the activating position, the actuator drives the gripping part 31 by driving and driven structures 43*a* and 33*a*. When the actuator lever 4 moves from the activating position to the rest position, the driving structure 43*a* releases the driven structure 33*a* such that the grip member 3 is urged by the grip spring 32 towards the flush position.

When the actuator lever 4 is in the rest position, and the gripping part 31 is pressed from outside the vehicle, the actuator lever 4 is also pressed by the drive and driving structures 33*a* and 43*a* so as to make the retaining device release the actuation lever 4 to move towards the activating position. This movement is shown by reference 4*c* in FIG. 9.

The actuator lever 4 further comprises a first locking structure 41*a* opposite to the driving structure 43*a* with respect to the actuator axis 40. The grip member 3 comprises a second locking structure 31*a* opposite to the driven structure 33*a* with respect to the grip axis 40.

The locking structures are configured such that when the grip member is moved from the active position to the opening position the second locking structure 31*a* drives the first locking structure 41*a* such that the actuator lever is driven towards the rest position, and presses the retaining device so as to be retained in the rest position.

Figure 11:
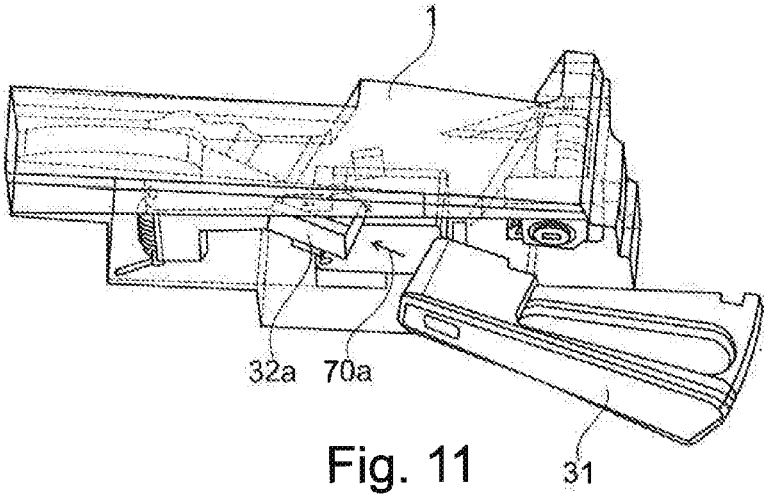
FIG. 11 is a perspective view of a handle being assembled according to a second form of the present disclosure.

FIGS. 11, 12 show the mounting of the handle of the second form. The handle comprises separate gripping part 31 and grip lever 32*a*. The grip lever 32*a* is manufactured with a handle bracket and the griping part 31 is mounted on the grip lever 31, such as for example, from outside the external panel 11 according to arrow 70*a*. The gripping part 31 is then fixed to the grip lever 32*a* for example by a screw 70.

In operation, when the grip member 3 is in the flush position, the user wanting to open the corresponding vehicle door pushes the gripping part 31 such that the driven structure 33*a* drives the driving structure 43*a* which in turn pushes the bistable spring mechanism. The actuator lever 4 is then released from the rest position and the actuator spring 42 drives the actuator lever 4 and thus the grip member 3 toward the opening position. This is made possible through the driving and driven structures 43*a* and 33*a*, and the force of the actuator spring 42 overcoming the force of the grip spring 32.

When the grip member 3 is in the active position, the user may pull the gripping part 31 according to an opening direction 11 toward the open position such that first locking protuberance 31*a* drives the second locking protuberance 41*a* so as to drive the actuator lever 4 towards the rest position, and also make the actuator lever 4 press the retaining device 5 to make the retaining device 5 retain the actuator lever 4 in the rest position. This movement is shown in FIG. 10.

With the actuator lever retained in the rest position, the grip member 3 is free to return to the flush position to the grip return 32.

Referring to FIGS. 13 to 17, the handle according to a third form of the present disclosure is a mechanical handle and has some similarities to the second form.

The grip member 3 has a plane shape with projections for a column 34 and for a locking structure 31*a* detailed below.

Figure 14A:
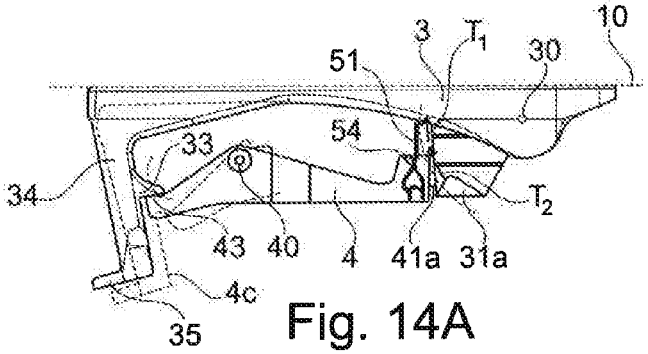
FIG. 14A is a top view of the handle of FIG. 13 in a flush position.
Figure 14B:
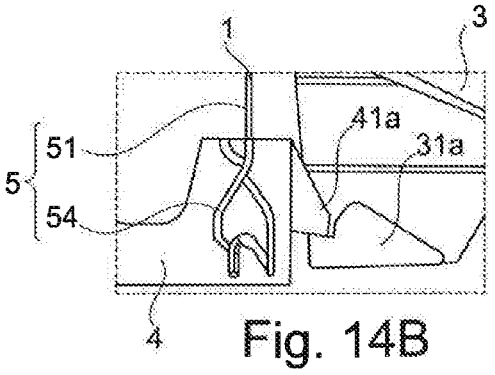
FIG. 14B is a partial top view illustrating a bistable spring arrangement of the handle of FIG. 14A in a flush position.
Figure 15:
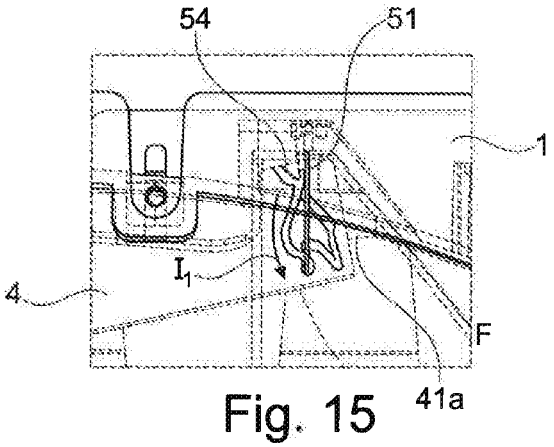
FIG. 15 is a top view illustrating a bistable spring arrangement of the handle of FIG. 13 in an active position.
Figure 16:
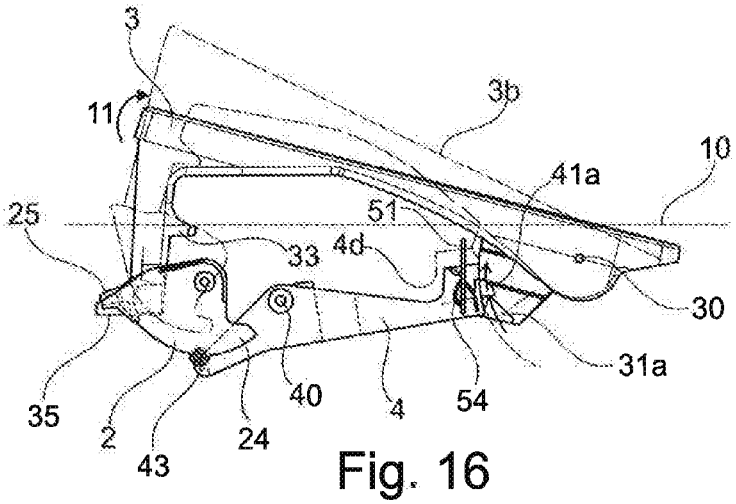
FIG. 16 is a top view of the handle of FIG. 13 in an active position.
Figure 17:
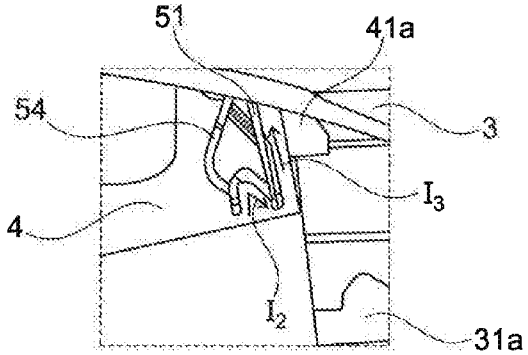
FIG. 17 is a top view of a bistable spring arrangement of the handle of FIG. 13 in an opening position.

In the third form, the flush position is shown in FIGS. 14A and 14B, the active position is shown in FIGS. 15 and 16 in normal lines, and the opening position is shown by reference 3*b* in FIG. 16 and also FIG. 17.

In the third form, the actuator lever 4 cooperates with the grip member 3 to block the grip member 3 from the flush position. To this end, the grip member 3 comprises a first locking structure 31*a* and the actuator lever 4 comprises a second locking structure 41*a* cooperating with the first locking structure 31*a*.

The actuator lever 4 is moveably mounted between a locking position and an unlocking position.

In the locking position, the actuator lever 4 blocks the grip member 3 in the flush position by the locking structures 31*a* and 41*a*.

In the unlocking position, the actuator lever 4 enables the grip member 3 to move towards the active position.

The actuator return 42, which is a spring, is configured to drive the actuator lever 4 towards the locking position.

The retaining device 5 is configured to retain the actuator lever 4 in the locking position.

More particularly, the first locking structure 31*a* defines a first trajectory T1 when the grip member 3 is moved from the flush position to the active position, and in the locking position, the second locking structure 41*a* blocks the first locking structure 31*a* so as to block the grip member 3 in the flush position.

When the actuator lever 4 is moved to the unlocking position, the second locking structure 41*a* is moved out of the first trajectory T1 of the first locking structure 31*a*.

The grip member further comprises a driving structure 33 and the actuator lever 4 comprises a driven structure 43 cooperating with the driving structure 33 as shown in FIG. 14A. The opposite end of the actuator lever comprises the bistable spring arrangement. The driving and driven structures 33 and 43 are protuberances.

Figure 14C:
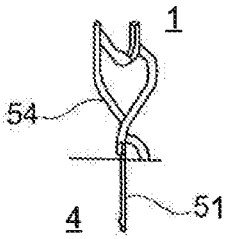
FIG. 14C is a top view of a bistable spring arrangement according to an alternative third form of the present disclosure.

A bistable spring arrangement comprises a linear spring 51 on a first part and a retaining path 54 on a second part of the handle. The linear spring 51 may be attached to a bracket 1 of the handle and the retaining path 54 may be provided on the actuator lever 4 as shown in FIG. 14B. Alternatively, the opposite arrangement may be used as shown in FIG. 14C, i.e. the linear spring 51 is attached to the actuator lever 4 and the retaining path 54 is in the bracket 1 as shown in FIG. 14C.

The linear spring is urged between two positions in the retaining path 54 as the first and second parts are pressed with respect to each other.

More particularly, when the grip member 3 is in the flush position and the gripping part is pressed from outside the door, the driving protuberance 33 drives the driven protuberance 43 such that the actuator lever 4 presses the retaining device 5 which in turn releases the actuator lever 4 from the locking position. This movement is shown in FIG. 14A. The grip member 3 is then moved towards the active position as shown in FIGS. 15 and 16.

When the grip member is in the active position and is moved to the opening position, the first locking structure 31*a* cooperates with the second locking structure 41*a* so as to drive the actuator lever 4 along a second trajectory T2 such that the actuator lever 4 presses the retaining device 5 which in turn releases the actuator lever 4 from the unlocking position.

The actuator lever 4 comprises a shaft rotationally mounted about an actuator axis 40, and the grip member is rotationally mounted about a grip axis 30 substantially parallel to the actuator axis 40.

The grip member 3 is spring biased towards the active position. A grip spring 32 is provided to this end.

In the third form, the actuator spring 42 drives the actuator lever towards the locking position. The actuator spring 42 has a force overcoming the grip spring 32 such that the grip member remains in the flush position.

In operation, when the user pushes the grip member 3 and the bistable spring mechanism, the user overcomes the force of the actuator spring 42 such that the actuator lever 4 is moved from the locking position to the unlocking position. The actuator lever is then retained in the unlocking position by the retaining device 5. Such a retaining overcomes the force of the actuator spring 42.

With the actuator lever 4 retained in the unlocking position, the second locking structure 41*a* is moved out of the first trajectory T1 of the first locking structure 31*a*. The first locking structure is then free to move according to the first trajectory so that the grip member is moved from the flush position to the active position, by the grip return 32.

When the grip member 3 is in the active position, the user may pull the gripping part 31 according to an opening direction 11 toward the open position such that first locking protuberance 31*a* drives the second locking protuberance 41*a* according to a second trajectory 41 such that the actuator lever 4 presses the bistable spring mechanism which releases the actuator lever 4 to move towards the locking position, by the force of the actuator spring 42. This movement is shown by FIG. 16, in particular references 3*b* and 4*d*.

The grip member 3 also moves towards the flush position as the force of the actuator spring 42 overcomes the force of the grip spring 32.

When the grip member 3 is in the active position, the user may also push the gripping part 31 towards the flush position such that driving protuberance 33 drives the driven protuberance 43 and such that the actuator lever 4 presses the bistable spring mechanism which releases the actuator lever 4 to move towards the locking position, by the force of the actuator spring 42. This movement is shown by FIG. 17, in particular by movements 12 and 13.

The grip member 3 is maintained in the flush position as the force of the actuator spring 42 overcomes the force of the grip spring 32.

The present disclosure has been described above with the aid of various forms without limitation of the general concept as defined in the claims.

In particular, in the third form, the linear spring may be replaced by or work with a damper. In this case, on the actuator lever 4 the push-push function made by the bistable spring received in the retaining path is replaced by a damper. The damper may be bi-directional or mono-directional. This damper allows the actuator lever 4 to come back slowly when the handle is out to let enough time to the user to take the handle in hand.

The damper also allows the handle to not stay in the active position.

The present disclosure enables having a flush handle with:

a grip member in rotation respect to the door with a rotation axis disposed between the two ends of the grip member;

the actuator lever in contact with the handle to liberate it for extraction and pull it for retraction;

the handle spring configured for pushing out the grip member, versus extraction side;

the actuator lever allowing the deployment of the grip member when the user pushed on it from outside;

a natural blocking of the handle under external acceleration, blocked by the actuator lever;

the assembly made from outside for the lockset and the handle, there is no need to remove inner panel to disassemble them when the vehicle is finished to be assembled;

a similar ergonomy to standard grip handle;

the possibility to motorized the actuator lever;

the automatic return when user pulls the grip member to open the door when the handle has a linear spring engaging in a retaining path; and the automatic return of the handle after having pushed it out when a damper is integrated in the handle.

Many modifications and variations will suggest themselves to those skilled in the art upon making reference to the foregoing illustrative forms, which are given by way of example only and which are not intended to limit the scope of the present disclosure, that being determined by the appended claims.

A protuberance on a first part cooperating with a recess on a second part, such that one of the parts drive the other, may alternatively be implemented with a different arrangement, i.e. one or more protuberance(s) and/or one or more recess(es) cooperating with each other where applicable.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A handle for a vehicle door comprising:

an activation member configured to activate a latch of a vehicle door to unlatch the door;

a grip member configured to cooperate with the activation member to unlatch the door, wherein the grip member comprises a gripping part and a grip lever, wherein the grip lever has a first arm connected to the gripping part and a second arm configured to cooperate with the activation member, the grip member being movable between:

a flush position in which the gripping part extends flush to an external panel of the door, an active position in which the gripping part projects with respect to the external panel and becomes graspable, and the grip member cooperates with the activation member, and an opening position in which the grip member drives the activation member to activate the latch and unlatch the door; and a driving mechanism and an actuator lever including a driving shaft and a driven shaft configured to cooperate with the second arm of the grip member such that the grip member may be moved between the flush position and the active position, wherein the handle is configured such that when the grip member is pulled according to an opening direction, the grip member drives the activation member which in turn activates the latch to unlatch the door, wherein the grip member is rotatably mounted about a grip axis and the actuator lever is rotatably mounted about an actuator axis, the grip axis and the actuator axis being substantially parallel to each other, wherein the handle further comprises an actuator spring configured to drive the actuator lever which in turn drives the grip member, wherein the grip member is spring biased towards the flush position by a grip spring, wherein the grip member comprises a driven structure and the actuator lever comprises a driving structure cooperating with the driven structure, wherein the grip member being urged towards the active position by the actuator spring through the actuator lever and the driving structure and the driven structure, and wherein a force of the actuator spring overcomes the grip spring when the actuator lever is driving the grip member.

2. The handle according to claim 1 further comprising:

a grip return configured to drive the grip member towards the flush position, wherein the actuator lever is moveable between:

an activating position in which the actuator lever drives the gripping member towards the active position, and a rest position in which the actuator lever releases the grip member;

an actuator return configured to drive the actuator lever towards the activating position; and a retaining device for retaining the actuator lever in the rest position.

3. The handle according to claim 1 further comprising:

a grip return configured to drive the grip member towards the active position, wherein the actuator lever is moveable between:

a locking position in which the actuator lever blocks the grip member in the flush position, and an unlocking position in which the actuator lever enables the grip member to move towards the active position;

an actuator return configured to drive the actuator lever towards the locking position; and a retaining device for retaining the actuator lever in the unlocking position.

4. The handle according to claim 1 further comprising a retaining device for retaining the actuator lever in at least one of a rest position and an unlocking position, the retaining device comprising a pressure sensitive bistable spring mechanism connected to the actuator lever and to a bracket, the bistable spring mechanism being movable between a retaining state in which the actuator lever is retained in the rest position or in the unlocking position, and a releasing state in which the actuator lever is released from said position.

5. The handle according to claim 4, wherein the retaining device comprises a clicking device configured to produce a clicking sound when the actuator lever is released from the rest position or from the unlocking position.

6. The handle according to claim 4, wherein the retaining device comprises a linear spring configured to be received in a retaining path.

7. The handle according to claim 6, wherein the linear spring is attached to a bracket of the handle and the retaining path is provided on the actuator level.

8. The handle according to claim 6, wherein the linear spring is urged between two positions in the retaining path as a first part and a second part of the handle are pressed with respect to each other.

9. The handle according to claim 4, wherein the retaining device comprises a damper.

10. The handle according to claim 9, wherein the damper is bi-directional or mono-directional.

11. The handle according to claim 1, wherein the actuator lever is driven by a motor.

12. The handle according to claim 1 further comprising at least one first switch and a first circuit, closed by a contact between the activation member and the grip member.

13. The handle according to claim 12 further comprising at least one second switch on a motor or on the actuator lever and at least one second circuit, the at least one second switch and the second circuit being configured to inform a user on a state of the actuator lever.

14. The handle according to claim 1, wherein the grip member comprises a driven structure and the actuator lever comprises a driving structure cooperating with the driven structure, wherein when the actuator lever is moved from a rest position to an activating position, the driving structure drives the driven structure such that the gripping part is moved from the flush position to the active position.

15. The handle according to claim 14, wherein the actuator lever has two opposite ends, wherein a second locking structure is placed at one end and the driven structure of the grip member is placed at an opposite end.

16. The handle according to claim 1, wherein the grip member comprises a first locking structure and the actuator lever comprises a second locking structure cooperating with the first locking structure, wherein when the grip member is moved from the active position to the opening position, the first locking structure drives the second locking structure so as to drive the actuator lever towards a rest position such that the actuator lever presses and is retained by a retaining device.

17. The handle according to claim 1, wherein the grip member comprises a first locking structure defining a first trajectory when the grip member is moved from the flush position to the active position, and the actuator lever comprises a second locking structure, wherein when the actuator lever is in a locking position, the second locking structure blocks the first locking structure so as to block the grip member in the flush position, and wherein when the actuator lever is in an unlocking position, the second locking structure is moved out of the first trajectory (T1) of the first locking structure.

18. The handle according to claim 1, wherein the grip member comprises a driving structure and the actuator lever comprises a driven structure cooperating with the driving structure such that when the grip member is in the flush position and the gripping part is pressed from outside the vehicle door, the driving structure drives the driven structure such that the actuator lever presses a retaining device which in turn releases the actuator lever from an unlocking position.

19. The handle according to claim 1, wherein when the gripping part moves from the active position to the opening position, a first locking structure cooperates with a second locking structure so as to drive the actuator lever along a second trajectory (T2) such that the actuator lever presses a retaining device which in turn releases the actuator lever from an unlocking position.

20. The handle according to claim 1, wherein the grip member comprises a column projecting towards the external panel of the door and the column comprises a first opening protuberance cooperating with a second opening protuberance on the activation member to unlatch the vehicle door, wherein the grip member further comprises a driving structure on the column.

* * * * *